United States Patent [19]

Johnson

[11] 3,937,404

[45] Feb. 10, 1976

[54] DRAIN DECLOGGING DEVICE

[76] Inventor: Arthur L. Johnson, 4921 3rd St., San Francisco, Calif. 94124

[22] Filed: June 9, 1975

[21] Appl. No.: 584,738

[52] U.S. Cl. ..... 239/567; 239/DIG. 13; 239/568; 4/256; 134/166 C; 134/167 C; 141/368

[51] Int. Cl.[2] ..... B05B 1/14; B05B 1/18; B08B 9/06

[58] Field of Search..... 239/DIG. 13, 548, 289, 239/567, 568, 602; 134/166 C, 167 C, 168 C, 169 C; 141/290, 310, 312, 311, 368–370, 372, 382, 386, 388, 390, 391, 392; 4/255, 256

[56] References Cited

UNITED STATES PATENTS

| | | | |
|---|---|---|---|
| 72,348 | 12/1867 | Wheeler | 239/568 |
| 539,422 | 5/1895 | Ebert | 141/368 X |
| 2,055,801 | 9/1936 | Perry | 4/256 X |
| 2,188,960 | 2/1940 | Schubring | 4/256 |
| 2,466,182 | 4/1949 | Peeps | 239/DIG. 13 |
| 2,673,986 | 4/1954 | Schaefer | 4/255 |
| 2,711,279 | 6/1955 | Day et al. | 141/368 X |
| 3,535,161 | 10/1970 | Gutrich | 134/167 C X |

FOREIGN PATENTS OR APPLICATIONS

| | | | |
|---|---|---|---|
| 1,409,744 | 10/1968 | Germany | 134/167 C |

*Primary Examiner*—Robert S. Ward, Jr.
*Attorney, Agent, or Firm*—Kurt A. Tauchen

[57] ABSTRACT

A drain clearance device comprising a length of flexible hose having at one of its ends means for connecting it to a source of water under pressure and at the other end a nozzle of elliptic contour longitudinally thereof and of a size to fit into a drain pipe. Said nozzle has four circumferentially spaced, slot-shaped orifices in the flanks of its rounded front end that are adapted to emit flat jets of water under increased pressure forwardly at an oblique angle against the inner surface of the drain pipe to dislodge and flush away any foreign matter that may have accumulated on the wall of the pipe and impede the free flow of water through the pipe. Intermediately of its ends the hose carries slidably mounted thereon means that may be manipulated to close the space around the hose to block back flow of water to the entrance opening of the drain during operation of the device.

5 Claims, 5 Drawing Figures

DRAIN DECLOGGING DEVICE

BACKGROUND OF THE INVENTION

The present invention relates to drain pipes intended to carry away waste materials in liquid suspension. Such waste materials whether solid or semi-solid, may adhere to the inner surface of the drain pipes and may in time impede and even block the flow of water through the pipe. This is especially true for bathroom and kitchen drains.

OBJECTS OF THE INVENTION

It is an object of the invention to provide an effective method and means for declogging bathroom and kitchen drains.

It is another object of the invention to provide a drain declogging means that is easy to operate without danger of back flow which may flood and contaminate the entrance of the drain that is to be cleared.

Still another object of the invention is to provide a drain declogging device of the type referred to, that is of simple and inexpensive construction.

SUMMARY OF THE INVENTION

In accordance with the invention I provide a length of flexible hose at one end with means for connecting it to a water outlet and at the other end with a nozzle of elliptic contour longitudinally thereof having four narrow slot-shaped circumferentially spaced orifices in the flanks of its forward end which are arranged to emit four blade-shaped jets of water under high pressure forwardly at an oblique angle against the inner surface of the drain pipe into which it is inserted, to dislodge and flush away any waste material that adheres to the inner surface of the drain pipe; and intermediately of its ends I mount slidably upon the hose means for blocking back flow of water in the drainpipe around the hose during operation of the device. Said back flow blocking means have preferably the form of two complementary hemispheres of a yieldably resilient material, such as sponge rubber, the flat section surface of one being provided with a centrally located semiglobular protuberance which fits into a semiglobular cavity or recess provided in the central area of the flat surface of the other hemisphere.

DETAILED DESCRIPTION OF A PREFERRED EMBODIMENT OF THE INVENTION

Figures 1, 2, 3, 4, 5:
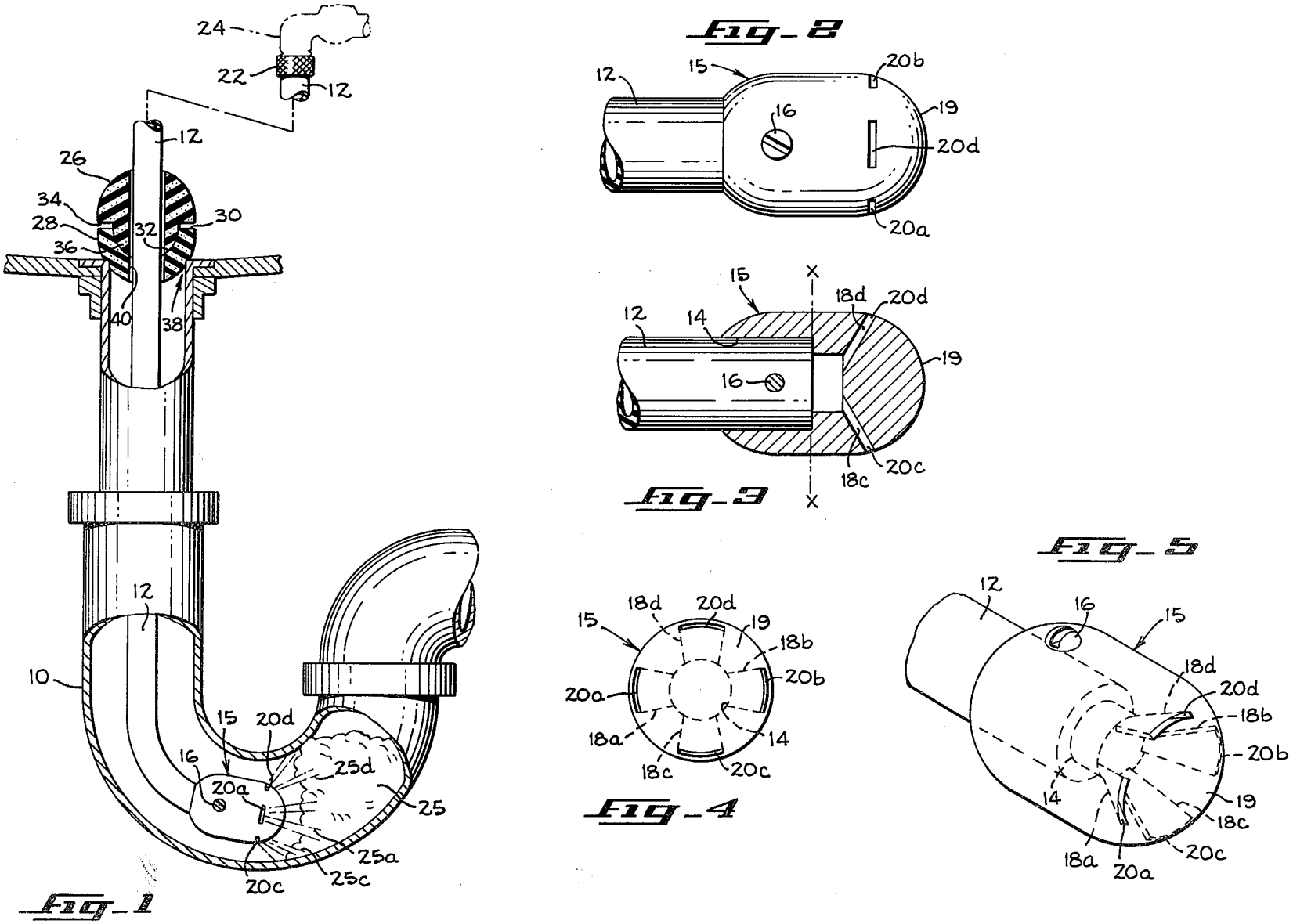
FIG. 1 is a side elevation of the goose neck portion of a drain pipe into which the drain declogging device of my invention has been inserted, with parts broken away to expose the declogging device within the drainpipe.
FIG. 2 is a side elevation of the nozzle at the front end of the drain declogging device of my invention.
FIG. 3 is a longitudinal section through the nozzle shown in FIG. 2.
FIG. 4 is a front elevation of the nozzle illustrated in FIGS. 2 and 3.
FIG. 5 is a perspective of the nozzle taken from a point in front and laterally of the nozzle and showing its interior passages in phantom lines.

In FIG. 1 the references numeral 10 identifies the goose neck portion of a drain pipe. Partly inserted into the pipe is a length of flexible hose 12 which is part of the drain declogging device of my invention. The leading end of the hose 12 is inserted into and penetrates the tubular entrance passage 14 of a nozzle 15 of elliptic shape. Said nozzle may be made of metal or a suitable plastic material and may be secured to the hose 12 by suitable means, such as the screw shown at 16 in FIGS. 1, 2, 3 and 5, or by one of the well known, firmly adhesive Epoxy resins. The passage 14 extends to or beyond the center line $x - x$ of the nozzle 15, and from four cardinal points of its inner end it branches into four passages 18*a*, 18*b*, 18*c* and 18*d* (FIG. 5) that slant outwardly and forwardly toward the flank area of the rounded front surface 19 of the nozzle where they form four narrow slot-shaped exit ports or orifices 20*a*, 20*b*, 20*c* and 20*d*, respectively. These orifices and the passages that lead to them should be narrow i.e., of limited height in a direction normal to the intended flow of water passing and exiting through them, but may be of substantial width as shown in FIGS. 2, 4 and 5.

The opposite and free end of the hose 12 is provided with suitable fittings 22 of conventional design for connecting it to a suitable water outlet such as a tap indicated in phantom lines at 24 or a garden hose. When the hose 12 is connected to a source of water under pressure, the stream of water entering the nozzle 15 is split into four narrow diverging branches that rush toward the forward end of the nozzle where they issue through the slot-shaped orifices 20*a*, 20*b*, 20*c* and 20*d* in four divergent blade-shaped jets as shown in FIG. 1, that are directed obliquely against inner surface of the drainpipe. Due to the thinness of the jets in a direction at right angles to the direction of the flow of water and the resultant increase in the velocity and power of the issuing jets of water, they hit the inner surface of the drain pipe and/or any waste matter 25 adhering thereto with increased force and carve such foreign matter from the surface of the drain pipe, break it up and flush the fragments forwardly through the drain pipe and thus unblock the pipe.

Since a clogged drain pipe, before fully unblocked by the device of my invention, may cause the water emitted by the nozzle 15 to back up and flow exteriorly of nozzle and hose 12 back to the inlet of the drain pipe minimizing the effect of the device of my invention and causing water and waste material to spill into and contaminate a wash basin, a bath tub, kitchen sink or the like, I provide means for preventing such back flow and thus maintaining the full effectiveness of the device. For this purpose I mount two complementary hemispheres 26 and 28 (FIG. 1) of resiliently yieldable material, such as sponge rubber, upon the hose behind the nozzle, i.e., in the region between the nozzle 15 and the fitting 22 in such a manner that they may slide snugly upon the hose in a forward or backward direction. The flat surface 30 of one of said hemispheres, preferably the leading one (in the direction of the flow of water through the hose 12) has a semiglobular cavity 32 while the flat surface 34 of the other is provided with a semiglobular protuberance 36 of a size to fit into the cavity of the former. During operation of the device when part of the hose and the nozzle on its front end are within the drain pipe 10, leading hemisphere 28 is slid down on the hose till it covers the entrance opening 38 of the drain pipe to block back flow of water around the hose, whereupon the trailing hemisphere 26 is slid downwardly on the hose 12 until its semiglobular protuberance 36 fits into the cavity 32 in the flat surface of the leading hemisphere 28. The second or trailing hemisphere 26 with its protuberance 36 limits back flow of water along the hose through the aperture 40 in the leading hemisphere through which the hose passes.

The drain clogging device of my invention is simple, inexpensive and effective. Due to the flexibility and length of the hose, it may be used to declog obstructions that lie in curved portions of the drain such as the "goose neck" traps that are commonly employed in drains, or obstructions that are located remote from the entrance opening 38 of the drain. The thin knife-blade like jets of water which its nozzle emits at great force disintegrate any obstructions on the walls of the drain and force its fragments to move on. The device of the invention is easy to operate effectively even by an unskilled person, it is not dangerous, it will cause no damage to the drain pipe nor is it likely to cause pollution of wash basins, bath tubs, sinks and the like due to back flow.

While I have described my invention with the aid of a particular embodiment thereof it is not limited to the constructional details shown and described by way of example which may be departed from without departing from the spirit and scope of my invention. Thus, the nozzle at the end of the hose may be provided with more than four peripherally located slot-shaped orifices to direct five or more knife-blade like jets against the inner wall of the drain pipe and any obstructing foreign matter accumulated thereon. I have found, however, that the provision of less than at least four such orifices materially reduces the effectiveness of the device.

I claim:

1. A drain-declogging device comprising a length of flexible hose of a size to fit into a drain pipe, having at one end thereof means for attaching it to a source of water under pressure and at the other end a nozzle of elliptical contour having in one of its short sectors an entrance passage adapted to receive the respective end of said hose and reaching to a central area of said hose, and extending obliquely outwardly from said passage to the outer surface of the flank area of the opposite short sector of said nozzle a plurality of circumferentially spaced flat passages terminating in slot-shaped orifices, and slidably engaged over the center portion of said hose intermediately of its ends, means for blocking back flow of water in said drain around and exteriorly of said hose.

2. A drain declogging device according to claim 1 having four circumferentially equi-spaced orifices located in the flank area of the front surface of said nozzles.

3. A drain declogging device according to claim 1 wherein said back-flow blocking means comprises a hemispherical leading section of resiliently yieldable material having its semiglobular surface located to face said nozzle.

4. A drain declogging device according to claim 3 wherein said leading hemispherical section has a planar trailing surface and said trailing surface has a semiglobular depression.

5. A drain declogging device according to claim 4 wherein said back flow blocking means comprises a trailing section having a planar leading surface, and forwardly projecting from said leading surface a protuberance adapted to fit into the cavity in the trailing surface of said leading section.

* * * * *